US009964340B2

(12) United States Patent
Nakano et al.

(10) Patent No.: US 9,964,340 B2
(45) Date of Patent: May 8, 2018

(54) STIRLING REFRIGERATOR

(71) Applicant: SUMITOMO HEAVY INDUSTRIES, LTD., Tokyo (JP)

(72) Inventors: Kyosuke Nakano, Nishitokyo (JP); Yoshikatsu HIRATSUKA, Nishitokyo (JP); Kenta Yumoto, Nishitokyo (JP)

(73) Assignee: SUMITOMO HEAVY INDUSTRIES, LTD., Shinagawa-Ku, Tokyo (JP)

( * ) Notice: Subject to any disclaimer, the term of this patent is extended or adjusted under 35 U.S.C. 154(b) by 178 days.

(21) Appl. No.: 14/666,498

(22) Filed: Mar. 24, 2015

(65) Prior Publication Data

US 2015/0276273 A1 Oct. 1, 2015

(30) Foreign Application Priority Data

Mar. 25, 2014 (JP) ..... 2014-062412

(51) Int. Cl.

| | |
|---|---|
| ***F25B 9/00*** | (2006.01) |
| ***F25B 9/14*** | (2006.01) |
| *F02G 1/043* | (2006.01) |
| *F02G 1/053* | (2006.01) |

(52) U.S. Cl.

CPC ..... *F25B 9/14* (2013.01); *F02G 1/043* (2013.01); *F02G 1/053* (2013.01); *F02G 2243/00* (2013.01); *F02G 2243/02* (2013.01); *F02G 2243/04* (2013.01); *F25B 2309/1428* (2013.01)

(58) Field of Classification Search

CPC ..... F25B 9/14; F25B 2309/1426; F25B 2313/031; F02G 1/043; F02G 2243/00; F02G 2243/02; F02G 2243/04

See application file for complete search history.

(56) References Cited

U.S. PATENT DOCUMENTS

| | | | | |
|---|---|---|---|---|
| 4,397,155 A * | 8/1983 | Davey | ..... | F02G 1/0435 60/520 |
| 4,945,726 A * | 8/1990 | Beale | ..... | F02G 1/0435 60/520 |
| 5,525,845 A * | 6/1996 | Beale | ..... | F02G 1/0435 310/12.27 |
| 7,257,949 B2 * | 8/2007 | Shimizu | ..... | F02G 1/0435 60/517 |

FOREIGN PATENT DOCUMENTS

| | | | | |
|---|---|---|---|---|
| JP | 2007-303721 A | | 11/2007 | |
| JP | 2007303721 | * | 11/2007 | ..... F25B 9/14 |

* cited by examiner

*Primary Examiner* — Keith Raymond
*Assistant Examiner* — Webeshet Mengesha
(74) *Attorney, Agent, or Firm* — Buchanan Ingersoll & Rooney PC

(57) ABSTRACT

In a Stirling refrigerator, a displacer has an internal space. An expander body houses the displacer so that the displacer can be reciprocated. A temperature sensor is arranged in the internal space of the displacer. A displacer rod, having an internal space, may connect to the displacer. A wiring may provide an electrical connection to the temperature sensor, the wiring arranged through the internal space of the displacer rod to outside of the expander body.

6 Claims, 3 Drawing Sheets

STIRLING REFRIGERATOR

RELATED APPLICATION

Priority is claimed to Japanese Patent Application No. 2014-62412, filed on Mar. 25, 2014, the entire content of which is incorporated herein by reference.

BACKGROUND OF THE INVENTION

1. Field of the Invention

The present invention relates to a refrigerator and it particular relates to a Stirling refrigerator or cryocooler.

2. Description of the Related Art

As for a Stirling refrigerator, known is a technology where a temperature sensor is mounted on an (outer) lateral surface of the Stirling refrigerator so as to detect the temperature of the Stirling refrigerator. The temperature information thus acquired is used for controlling the drive voltage used to drive the Stirling refrigerator, for instance.

SUMMARY OF THE INVENTION

One exemplary purpose of an aspect of the present invention is to provide a technology for measuring the temperature near a low temperature area of a displacer while an increase in the size of a Stirling refrigerator is suppressed.

According to an embodiment of the present invention, a Stirling refrigerator includes: a displacer having an internal space; an expander body that houses the displacer such that the displacer is movable in a reciprocating manner; and a temperature sensor arranged in the internal space of the displacer.

Another embodiment of the present invention relates also to a Stirling refrigerator. The Stirling refrigerator includes: a compressor that compresses a working gas; a displacer that reciprocates in conjunction with the compressor; an expander body that houses the displacer to form an expansion space between the expander body and the displacer; a temperature sensor arranged in an internal space of the displacer; and a control unit that controls an input value of a control signal of the compressor, based on a temperature acquired from the temperature sensor, such that a stroke of the displacer is controlled to a predetermined value.

Optional combinations of the aforementioned constituting elements, and implementations of the invention in the form of methods, apparatuses, systems, and so forth may also be practiced as additional modes of the present invention.

BRIEF DESCRIPTION OF THE DRAWINGS

Embodiments will now be described, by way of example only, with reference to the accompanying drawings, which are meant to be exemplary, not limiting, and wherein like elements are numbered alike in several figures, in which.

DETAILED DESCRIPTION OF THE INVENTION

Figure 1:
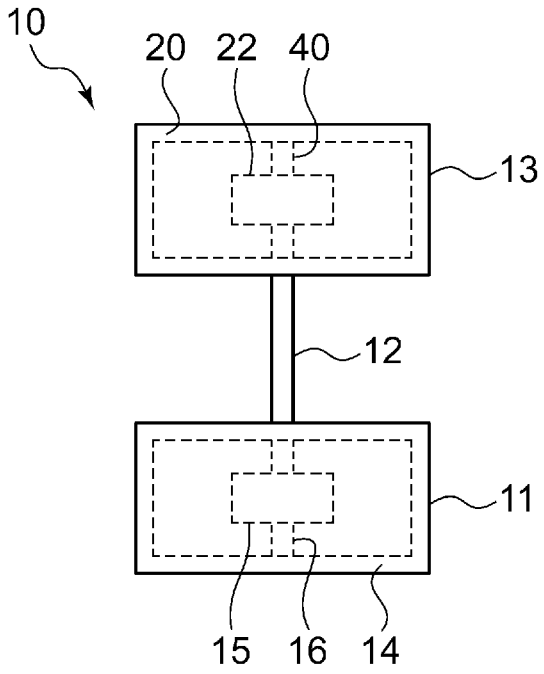
FIG. 1 schematically shows a Stirling refrigerator according to an embodiment of the present invention.

The invention will now be described by reference to the preferred embodiments. This does not intend to limit the scope of the present invention, but to exemplify the invention.

In general, a Stirling refrigerator (Stirling cryocooler) is utilized in such a manner that it is contained in a vacuum vessel, for the purpose of suppressing or preventing the heat from entering thereinto. For this reason, a wiring used to detect the temperature needs to be led out to the exterior of the vacuum vessel when a temperature sensor has been installed in a lateral surface of the Stirling refrigerator. In order to achieve this, a wiring introduction terminal or the like, which is hermetically sealed, is provided in a port through which the wiring is led in and out of the vacuum vessel.

Due to a structural constraint and the like in the Stirling refrigerator, the wiring introduction terminal, which is hermetically sealed, is generally provided in a flange of the vacuum vessel. However, incorporation of the wiring introduction terminal into the flange increases the size of the flange thereby both the overall weight and the size of the Stirling refrigerator are increased. Also, a conductive heat may possibly enter the vacuum vessel from the exterior through the wiring and the temperature sensor. In the light of this, the Stirling refrigerator according to one embodiment of the present invention is configured such that a displacer has an internal space and such that the temperature sensor is arranged in the internal space.

A detailed description will be hereinafter given of embodiments by which to carry out the present invention, with reference to the accompanying drawings. The same or equivalent constituents in explaining the drawings will be denoted with the same reference numerals, and the repeated description thereof will be omitted as appropriate. Moreover, the embodiments given hereinbelow are for illustrative purposes only and does not limit the scope of the present invention.

FIG. 1 schematically shows a Stirling refrigerator 10 according to an embodiment of the present invention. The Stirling refrigerator 10 includes a compressor 11, a connecting pipe 12, and an expander 13.

The compressor 11 includes a compressor casing 14. The compressor casing 14 is a pressure vessel that is so configured as to hermetically hold a high-pressure working gas. The working gas as used herein may be helium gas, for instance. Also, the compressor 11 includes a compressor unit that is contained in the compressor casing 14. The compressor unit has a compressor piston and a compressor cylinder, one of which is a movable member 15 configured to reciprocate inside the compressor casing 14 and the other of which is a static member secured to the compressor casing 14. The compressor unit has a drive source used to move the movable member 15 relative to the compressor casing 14 in a direction along a central axis of the movable member 15. The compressor 11 includes a support 16 that supports the movable member 15 relative to the compressor casing 14 so that the movable member 15 can move in a reciprocating manner. The movable member 15 vibrates relative to the compressor casing 14 and the static member with certain amplitude and frequency. As a result, the volume of the working gas inside the compressor 11 also vibrates with predetermined amplitude and frequency.

A working gas chamber is formed between the compressor piston and the compressor cylinder. The working gas chamber is connected to one end of the connecting pipe 12 through a communicating path formed in the aforementioned static member and the aforementioned compressor casing 14. The other end of the connecting pipe 12 is connected to a working gas chamber of the expander 13. In this manner, the working gas chamber of the compressor 11 is connected to the working gas chamber of the expander 13 by the connecting pipe 12.

As will be described later by reference to FIG. 2, the expander 13 includes an expander body 20, a displacer 22, and a support 40.

Figure 2:
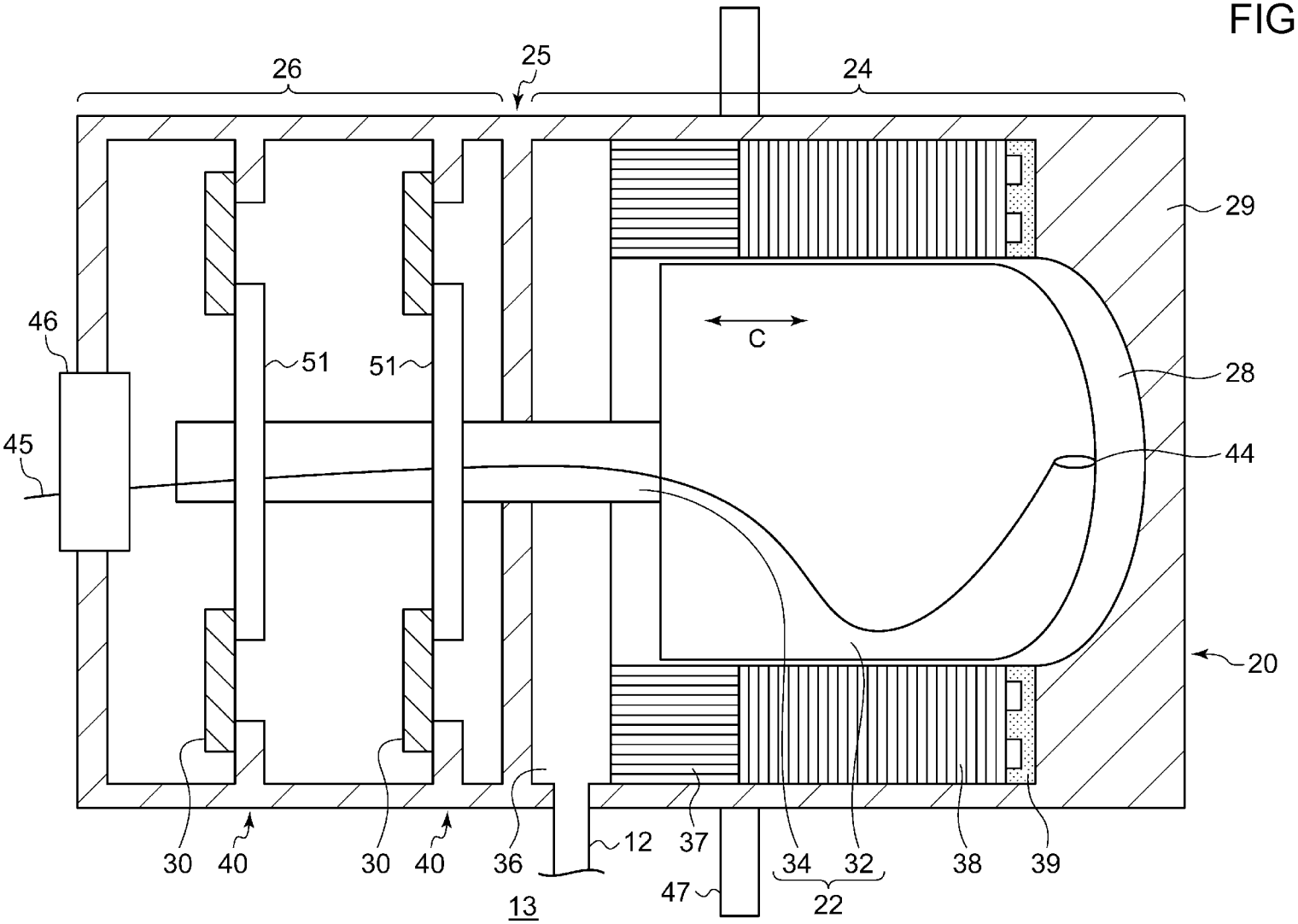
FIG. 2 schematically shows an expander of a Stirling refrigerator according to an embodiment of the present invention.

FIG. 2 schematically shows the expander 13 according to an embodiment of the present invention. FIG. 2 schematically illustrates an internal structure of the expander 13.

The expander 13 includes the expander body 20 and the displacer 22. The expander body 20 is a pressure vessel that is so configured as to hermetically hold a high-pressure working gas. The displacer 22 is a movable member configured to reciprocate inside the expander body 20. Also, the expander 13 includes at least one support 40 that supports the displacer 22 relative to the expander body 20 so that the displacer 22 can move in a reciprocating manner.

The expander body 20 includes a first section 24 and a second section 26. The first section 24 includes an expansion space 28, for the working gas, which is formed between the expander body 20 and the displacer 22. A cooling stage 29, which is used to cool an object, is provided in the part of the expander body 20 adjacent to the expansion space 28. The second section 26 is configured such that the displacer 22 is supported relative to the expander body 20 by way of an elastic member 30.

A part of the expander body 20 on a first section 24 side is contained in the not-shown vacuum vessel. A flange 47 separates a vacuum layer inside the vacuum vessel from an air layer outside the vacuum vessel, and vice versa.

The second section 26 is located adjacent to the first section 24 in a reciprocating direction of the displacer 22 (indicated by a double arrow C in FIG. 2). A sealing portion 25 is provided between the second section 26 and the first section 24, and thereby the second section 26 is partitioned from the first section 24. Thus, the pressure variation of the working gas in the first section 24 is not at all transmitted to the second section 26 or has little effect on the pressure of the working gas in the second section 26. Note that the second section 26 is filled with a gas, which is the same kind as the working gas, such that the pressure thereof is equal to an average pressure of the working gas supplied from the compressor 11.

The displacer 22 includes a displacer body 32, which is contained in the first section 24, and a displacer rod 34. The displacer rod 34 is a shaft part, which is narrower than the displacer body 32. The displacer 22 has a central axis parallel with the reciprocating direction of the displacer 22, and the displacer body 32 and the displacer rod 34 are provided coaxially with the central axis. The displacer 22 has an internal space and is filled with a gas, which is the same kind as the working gas. A temperature sensor for measuring a cold temperature generated by the Stirling refrigerator 10 is placed in the internal space of the displacer 22. The temperature sensor will be discussed later in detail.

The displacer rod 34 extends from the displacer body 32 to the second section 26 by passing through the sealing portion 25. The displacer rod 34 is supported by the expander body 20 in the second section 26 in such a manner as to enable the reciprocating movement of the displacer 22. The aforementioned sealing portion 25 may be a rod seal formed between the displacer rod 34 and the expander body 20. Note that the displacer rod 34 has an internal space, too, similarly to the displacer 22. The displacer rod 34 connects to the displacer body 32 and communicates with the internal space of the displacer 22.

The first section 24 forms a cylinder portion that surrounds the displacer body 32. The expansion space 28 is formed between a bottom face of the cylinder portion and an end face of the displacer body 32. The expansion space 28 is formed on a side opposite to a joint part of the displacer body 32 and the displacer rod 34, in the reciprocating direction C of the displacer 22. A gas space 36, which is connected to the connecting pipe 12, is formed between the joint part and the sealing portion 25.

A regenerator 38 is mounted on a side surface of the cylinder portion of the expander body 20 such that the regenerator 38 is positioned around a periphery of the displacer body 32. More specifically, the regenerator 38 is provided on the side surface of the cylinder portion of the expander body 20 such that the regenerator 38 is arranged around the periphery of the displacer body 32 to form a cylindrically-shaped region, whose central axis coincides with the longitudinal axis of the displacer 22. The regenerator 38 is of a stacking structure of metal meshes, for instance. The working gas can flow between the expansion space 28 and the gas space 36, by way of the regenerator 38.

A water-cooled heat exchanger 37 is provided between the regenerator 38 and the gas space 36. The water-cooled heat exchanger 37 performs a heat exchange operation in which the working gas supplied from the compressor 11 is cooled and then the heat thereof is released outside the expander 13. A low-temperature heat exchanger 39 is placed between the regenerator 38 and the cooling stage 29.

The expander 13 supports the displacer 22 relative to the expander body 20, at a plurality of positions in the reciprocating direction of the displacer 22, in such a manner as to enable the reciprocating movement of the displacer 22. For this purpose, the expander 13 includes two supports 40. The two supports 40 are provided in the second section 26. In this manner, the tilting of the displacer 22 against the central axis can be suppressed.

Each support 40 has the aforementioned elastic member 30. The elastic member 30 is arranged between the displacer rod 34 and the expander body 20 such that an elastic restoring force is exerted on the displacer 22 when the displacer 22 is displaced from its neutral position. Thereby, the displacer 22 makes a reciprocating movement with a natural frequency. This natural frequency is determined by a spring constant of the elastic member 30, a spring constant resulting from the pressure of the working gas, and the weight of the displacer 22.

The elastic member 30 includes, for example, a spring mechanism having at least one plate spring. The plate spring, which is also called a flexure spring, is flexible in the reciprocating direction of the displacer 22 and is rigid in a direction perpendicular to the reciprocating direction. Such a plate spring is disclosed, for example, in Japanese Patent Application Publication No. 2008-215440, the entire content of which is incorporated herein by reference. Thus, the elastic member 30 permits the movement of the displacer 22 in a direction along the central axis of the displacer 22 but restricts the movement thereof in a direction perpendicular thereto. The displacer rod 34 is secured to the elastic member 30 by way of an elastic member mounting portion 51.

As described above, a vibration system comprised of the displacer 22 and the elastic member 30 is constructed. The vibration system is configured such that the displacer 22 vibrates with the same frequency as that of the movable member 15 of the compressor 11 with having a certain phase difference between these vibrations. The displacer 22 is driven by the pressure pulsation of the working gas generated by the vibration of the movable member 15 of the compressor 11. The reciprocating motions of the displacer 22 and the movable member 15 of the compressor 11 form a reverse Stirling cycle between the expansion space 28 and the working gas chamber of the compressor 11. In this manner, the cooling stage 29 located adjacent to the expansion space 28 is cooled, so that the Stirling refrigerator 10 can cool the object.

A description is now given of the temperature sensor for measuring the temperature of the Stirling refrigerator 10 according to an embodiment.

As discussed earlier, the displacer 22 according to the embodiment has the internal space filled with a gas, which is the same kind as the working gas. The displacer 22 is hollowed out to reduce the weight of the displacer 22. This contributes to reducing the weight of the Stirling refrigerator as a whole. Because the internal space of the displacer 22 is filled with a gas, which is the same kind as the working gas, the working gas can be prevented from being contaminated even if, for some reasons, the gas inside the displacer 22 is leaked out to the first section 24 or the second section 26.

In the Stirling refrigerator 10 according to the embodiment, a temperature sensor 44 is placed in the internal space of the displacer 22. Also, a wiring 45 provides an electrical connection for measuring the temperature to the temperature sensor 44. The wiring 45 passes through the internal space of the displacer rod 34. One end of the wiring 45 connects to the temperature sensor 44, and the other end thereof is led out from a second section 26 side to the exterior of the expander body 20. The temperature sensor 44 as used herein may be realized by using a known art and a known component such as a resistance temperature detector (RTD), a thermistor, a thermocouple or a radiation thermometer. The wiring 45 connects to the temperature sensor 44 that reciprocates together with the displacer 22. Thus, the wiring 45 is a wiring that is flexible in nature. The wiring 45 has a length such that the wiring 45 has a certain degree of slackness when the displacer 22 is positioned in a bottom dead point (where the displacer 22 reaches the lowest temperature site). In an embodiment, a conductive spring which has elasticity in the reciprocating direction of the displacer 22 may be used for the wiring 45 in order to provide an electrical connection to the temperature sensor 44, instead of using the flexible wiring.

As described already, the second section 26 of the expander body 20 is filled with a gas, which is the same kind as the working gas, such that the pressure thereof is equal to the average pressure of the working gas fed from the compressor 11. Thus, the wiring 45 is led out to the exterior of the expander body 20 through a hermetically-sealed wiring introduction terminal 46. The wiring introduction terminal 46 as used herein may be achieved by using a known hermetic connector, for instance.

Here, the "internal space of the displacer 22" means an inner part of an outer surface of the displacer 22. Accordingly, the internal space of the displacer 22 includes not only the hollowed region filled with the gas but also the interior of a wall of the displacer 22. Though FIG. 2 shows a case where the temperature sensor 44 is mounted on an inner surface of the displacer 22, the temperature sensor 44 may instead be embedded inside the wall of the displacer 22.

Here, the "the temperature of the Stirling refrigerator 10" means the temperature of the working gas in the expansion space 28 that is subjected to the coldness or low temperature produced by the Stirling refrigerator 10. Thus the temperature of the Stirling refrigerator 10 can be detected with accuracy if the temperature sensor 44 can be provided within the expansion space 28, namely, on the outer surface of the displacer 22 on an expansion space 28 side or an outer surface of the cooling stage 29 on an expansion space 28 side. However, since the displacer 22 makes a reciprocating movement in the expander body 20, the displacer 22 and the cooling stage 29 comes close to each other when the displacer 22 is positioned in the bottom dead point. Also, a clearance between the displacer 22 and the expander body 20 is narrow and therefore it is difficult to have the wiring 45 pass through this clearance. This makes it difficult to install the temperature sensor 44 within the expansion space 28.

For this reason, the temperature sensor 44 is located in a deep part of the internal space of the displacer 22 beyond the regenerator 38 in a direction from a high-temperature end toward a low-temperature end of the regenerator 38. In other words, for the reciprocating direction of the displacer 22, the temperature sensor 44 is constantly positioned nearer to the cooling stage 29 than the regenerator 38. In the internal space of the displacer 22, the temperature sensor 44 is preferably arranged in a region adjacent to the expansion space 28. This allows the temperature of the working gas in the expansion space 28 to be detected with higher accuracy.

As described above, the Stirling refrigerator 10 according to the embodiment is configured such that the temperature sensor 44 is placed in the internal space of the displacer 22 by making use of a structure where the displacer 22 is hollowed out. Since the temperature sensor 44 is not installed within the not-shown vacuum vessel, the wiring 45 does not pass through or around the flange 47, which forms a boundary between the vacuum layer and the air layer. This eliminates the necessity of mounting the hermetically-sealed wiring introduction terminal to the flange 47 and therefore an increase in the size of the flange 47 can be suppressed.

FIG. 2 illustrates a case where the temperature sensor 44 is mounted on an inner wall of the displacer 22. Alternative to this case, the temperature sensor 44 can be arranged such that the temperature sensor 44 does not come in contact with the inner wall of the displacer 22. A description is given hereunder of this alternative case.

Figure 3:
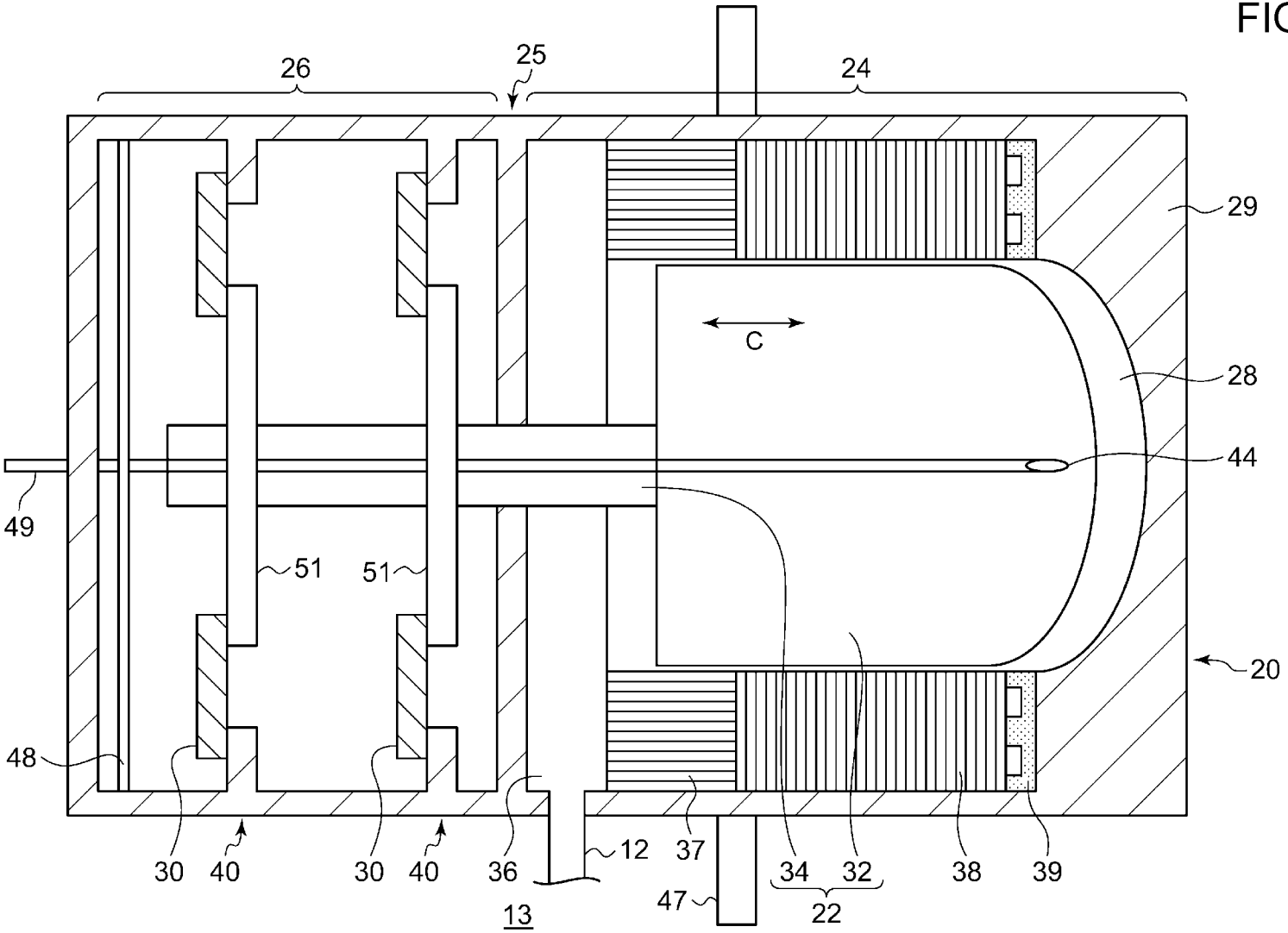
FIG. 3 schematically shows an expander of a Stirling refrigerator according to another embodiment of the present invention.

FIG. 3 schematically shows an expander 13 of a Stirling refrigerator 10 according to another embodiment of the present invention. For the components of FIG. 3 identical to those of FIG. 2, the repeated description thereof will be omitted or simplified as appropriate.

The expander 13 shown in FIG. 3 includes a fixed member 48, which is secured to an inner wall of the second section 26 of the expander body 20. The fixed member 48 secures a shaft 49 to the expander body 20 and supports the shaft 49 relative thereto. Here, the shaft 49 extends into an internal space of the displacer 22 by passing through an internal space of the displacer rod 34. A temperature sensor 44 is fixed to an end of the shaft 49 on an internal space side thereof. Although not shown in FIG. 3, a wiring 45 for use in the measurement of the temperature, which connects to the temperature sensor 44, is led out to the exterior of the expander body 20 such that the wiring 45 passes through the interior of the shaft 49 or is wound around the shaft 49. The shaft 49 can be achieved by using a resin pipe, for instance.

As illustrated in FIG. 3, the temperature sensor 44 is secured to the expander body 20 by way of the shaft 49 and the fixed member 48. The temperature sensor is not secured to the displacer 22. The temperature sensor 44 and the wiring 45 are configured independently of the displacer 22 and therefore do not move together or simultaneously with the reciprocating movement of the displacer 22. The number of moving parts is reduced as compared with the case where the temperature sensor 44 is mounted on the inner wall of the displacer 22, so that the disconnection of the wiring 45 and the failure rate of the temperature sensor 44 can be reduced.

As discussed above, when the Stirling refrigerator 10 operates in steady state, the displacer 22 makes a reciprocating movement with a natural frequency, which is determined by the spring constant of the elastic member 30, the spring constant resulting from the pressure of the working gas and the weight of the displacer 22. Thus, a difference in the weight of the displacer 22 has an effect on the reciprocating cycle of the displacer 22 as well. Since the expander 13 shown in FIG. 3 is configured such that the temperature sensor 44 is not fixed to the displacer 22, the weight of the displacer 22 does not increase even though the temperature sensor 44 is installed. As a result, the temperature sensor 44 can be installed without affecting the reciprocating cycle of the displacer 22.

In the internal space of the displacer 22, the temperature sensor 44 shown in FIG. 3 is preferably arranged in a region adjacent to the expansion space 28, which is similarly to the temperature sensor 44 shown in FIG. 2. Note here that the inner wall of the displacer 22 comes closest to the temperature sensor 44 when the displacer 22 is positioned in a top dead point (where the displacer 22 reaches the highest temperature site). Thus, the length of the shaft 49 is determined such that when the displacer 22 is positioned at the top dead point, the temperature sensor 44 does not hit the inner wall of the displacer 22. This may be appropriately determined by taking into consideration the axial length of the internal space of the displacer 22, the longitudinal length of the expander body 20 and so forth.

As described above, the expander 13 shown in FIG. 3 is also configured such that the temperature sensor 44 is placed in the internal space of the displacer 22 by making use of the structure where the displacer 22 is hollowed out. Since the temperature sensor 44 is not installed within the not-shown vacuum vessel, the wiring 45 does not pass through or around the flange 47, which forms a boundary between the vacuum layer and the air layer. This eliminates the necessity of mounting the hermetically-sealed wiring introduction terminal to the flange 47 and therefore an increase in the size of the flange 47 can be suppressed.

A description has been given of the place and the position where the temperature sensor 44 is installed in the expander 13 of the Stirling refrigerator 10. The Stirling refrigerator 10 according to the present embodiment controls an operation of the compressor 11 using the temperature information detected by the temperature sensor 44. A description is now given of controlling the operation thereof.

As discussed above, the compressor 11 includes the movable member 15, and the movable member 15 vibrates relative to the compressor casing 14 and the static member with certain amplitude and frequency. As a result, the volume of the working gas also vibrates with predetermined amplitude and frequency. The working gas flows into the expander 13 through the connecting pipe 12. The displacer 22 is driven by the pressure pulsation of the working gas generated by the vibration of the movable member 15 of the compressor 11.

In the Stirling cycle, the movable member 15 in the compressor 11 and the displacer 22 in the expander 13 vibrate harmonically. In other words, it is known that even though a variable volume of the working gas inside the compressor 11 and a variable volume of the expansion space 28 vibrate harmonically, a pressure variation is generated in the working gas within the system if the following three conditions (first to third conditions) are met.

The first condition: a displacement in the variable volume of the working gas inside the compressor 11 differs from a displacement in the variable volume of the expansion space 28.

The second condition: a phase of the displacement in the variable volume of the working gas inside the compressor 11 differs from a phase of the displacement in the variable volume of the expansion space 28.

Third condition: there is a temperature difference between at both ends of the regenerator 38.

It is known that if the above first to third conditions are met, the pressure variation in the working gas causes anharmonic vibration.

As described already, when the Stirling refrigerator 10 runs in steady state, the displacer 22 makes a reciprocating movement with a natural frequency, which is determined by the spring constant of the elastic member 30, the spring constant resulting from the pressure of the working gas and the weight of the displacer 22. There may be practically no temperature difference between at both ends of the regenerator 38 immediately after the startup of the Stirling refrigerator 10, and therefore there may possibly a period of time during which no pressure variation occurs in the working gas. During such a time period, the stroke length of the displacer 22 is larger due to no or significant small spring constant resulting from the pressure of the working gas. As a result, the displacer 22 may possibly hit the inner wall of the expander body 20. It is therefore preferable that the working gas pressure, which is a drive source of the displacer 22, is kept lower before the temperature difference between at both ends of the regenerator 38 occurs, namely before the low-temperature end of the regenerator 38 is sufficiently cooled, than when the Stirling refrigerator 10 is in stable state.

In the light of this, a control unit, not illustrated, is provided within the compressor 11 of the Stirling refrigerator 10 according to an embodiment. The control unit controls an input value of a control signal of the compressor 11, based on the temperature acquired from the temperature sensor 44, such that the stroke of the displacer 22 is controlled to a predetermined value. More specifically, if the temperature acquired from the temperature sensor 44 is greater than or equal to a predetermined temperature, the control unit will lower the drive voltage of the compressor 11 and thereby the working gas pressure, which is the drive source of the displacer 22, will be reduced. This can make the stroke of the displacer 22 shorter and can prevent the displacer 22 from hitting the inner wall of the expander body 20.

As described above, the Stirling refrigerator 10 according to the embodiments of the present invention provides the technology for measuring the temperature near a low temperature area of the displacer while an increase in the size of the Stirling refrigerator is suppressed.

The present invention has been described based on the exemplary embodiments and such description is for illustrative purposes only. It is understood by those skilled in the art that various changes in design and the like are possible and that such modifications arising from the changes are also within the scope of the present invention.

In each of the above-described embodiments, a description has been given of the case where the Stirling refrigerator 10 is provided with the temperature sensor 44 in the internal space of the displacer 22. The Stirling refrigerator 10 may include an acceleration sensor in the inner space of the displacer 22 in place of or in addition to the temperature sensor 44. Installation of the acceleration sensor allows the control unit within the compressor 11 to directly grasp the stroke of the displacer 22.

In each of the above-described embodiments, a description has been given of the case where the temperature sensor 44 is achieved by using the RTD, the thermistor, the thermocouple, the radiation thermometer or the like. Instead, a strain gauge may be installed on a wall surface of the internal space of the displacer 22, so that the temperature of the displacer 22 can be estimated from its strain amount. Here, the strain gauge is a measurement tool that uses its property of expanding and contracting according to the temperature of the displacer 22.

In each of the above-described embodiments, a description has been given of the case where the expander 13 and the compressor 11 are connected to each other by the connecting pipe 12, and the present embodiments are also applicable to a Stirling refrigerator where the expander 13 and the compressor 11 are integrally formed with each other.

It should be understood that the invention is not limited to the above-described embodiments, but may be modified into various forms on the basis of the spirit of the invention. Additionally, the modifications are included in the scope of the invention.

What is claimed is:

1. A Stirling refrigerator comprising:

a hollow displacer having an internal space;

an expander body that houses the hollow displacer such that the hollow displacer is movable in a reciprocating manner; and a temperature sensor arranged in the internal space of the hollow displacer.

2. The Stirling refrigerator according to claim 1, further comprising:

a hollow displacer rod that connects to the hollow displacer, the hollow displacer rod having an internal space, the internal space of the hollow displacer rod communicating with the internal space of the hollow displacer; and a wiring that provides an electrical connection to the temperature sensor, the wiring arranged through the internal space of the hollow displacer rod to outside of the expander body.

3. The Stirling refrigerator according to claim 1, further comprising:

a hollow displacer rod that connects to the hollow displacer, the hollow displacer rod having an internal space; and a shaft that extends through the internal space of the hollow displacer rod into the internal space of the hollow displacer, the shaft being fixed to the expander body, wherein the temperature sensor is fixed to the shaft.

4. The Stirling refrigerator according to claim 1, further comprising a regenerator provided in the expander body and arranged around the hollow displacer to form a cylindrically-shaped region whose central axis coincides with a longitudinal axis of the hollow displacer, wherein the temperature sensor is located in a deep part of the internal space of the hollow displacer beyond the regenerator in a direction from a high-temperature end toward a low-temperature end of the regenerator.

5. A Stirling refrigerator comprising:

a compressor that compresses a working gas;

a hollow displacer that reciprocates in conjunction with the compressor;

an expander body that houses the hollow displacer to form an expansion space between the expander body and the hollow displacer;

a temperature sensor arranged in an internal space of the hollow displacer; and a control unit that controls an input value of a control signal of the compressor, based on a temperature acquired from the temperature sensor, such that a stroke of the hollow displacer is controlled to a predetermined value.

6. The Stirling refrigerator according to claim 1, wherein the temperature sensor is mounted to the hollow displacer so as to reciprocate together with reciprocating movement of the hollow displacer.

* * * * *